US006495464B1

(12) United States Patent
Boyd et al.

(10) Patent No.: US 6,495,464 B1
(45) **Date of Patent: *Dec. 17, 2002**

(54) METHOD AND APPARATUS FOR FIXED ABRASIVE SUBSTRATE PREPARATION AND USE IN A CLUSTER CMP TOOL

(75) Inventors: John M. Boyd, Atascadero, CA (US); Michael S. Lacy, Atascadero, CA (US)

(73) Assignee: LAM Research Corporation, Fremont, CA (US)

( * ) Notice: Subject to any disclaimer, the term of this patent is extended or adjusted under 35 U.S.C. 154(b) by 4 days.

This patent is subject to a terminal disclaimer.

(21) Appl. No.: 09/609,590

(22) Filed: Jun. 30, 2000

(51) Int. Cl.[7] ..... H01L 21/302

(52) U.S. Cl. ..... 438/690; 438/691; 438/692; 438/693; 438/694; 438/700

(58) Field of Search ..... 438/690, 691, 438/692, 693, 694, 700; 451/41

(56) References Cited

U.S. PATENT DOCUMENTS

| | | | | |
|---|---|---|---|---|
| 3,753,269 | A | 8/1973 | Budman | 15/160 |
| 4,318,250 | A | 3/1982 | Klievoneit et al. | 45/295 |
| 4,510,113 | A | 4/1985 | Takano et al. | 264/257 |
| 4,576,612 | A | 3/1986 | Shukla et al. | 51/295 |
| 4,672,985 | A | 6/1987 | Mohr | 134/57 R |
| 4,720,939 | A | 1/1988 | Simpson et al. | 451/5 |
| 4,728,552 | A | 3/1988 | Jensen, Jr. | 428/91 |
| 4,753,838 | A | 6/1988 | Kimura et al. | 428/91 |
| 4,841,680 | A | 6/1989 | Hoffstein et al. | 451/42 |
| 4,927,432 | A | 5/1990 | Budinger et al. | 51/298 |
| 4,934,102 | A | 6/1990 | Leach et al. | 451/140 |
| 4,954,141 | A | 9/1990 | Takiyama et al. | 51/290 |
| 4,962,562 | A | 10/1990 | Englund et al. | 15/230.16 |
| 5,020,283 | A | 6/1991 | Tuttle | 451/550 |
| 5,081,051 | A | 1/1992 | Mattingly et al. | 451/56 |
| 5,104,421 | A | 4/1992 | Takizawa et al. | 51/295 |

(List continued on next page.)

FOREIGN PATENT DOCUMENTS

| | | |
|---|---|---|
| EP | 0 738 561 | 10/1996 |
| EP | 0 824 995 | 2/1998 |
| EP | 0 893 203 A | 1/1999 |
| JP | 63-267155 | 2/1989 |
| JP | 8-187798 | 11/1996 |
| WO | WO 98/35785 | 8/1998 |
| WO | WO 98/36442 | 8/1998 |
| WO | WO 98/45090 | 10/1998 |
| WO | WO 99 06182 | 2/1999 |
| WO | WO 99/22908 | 5/1999 |

OTHER PUBLICATIONS

U.S. patent application Ser. No. 09/540,385 Method and Apparatus for Chemically–Mechanically Polishing Semiconductor Wafers—Inventors: Travis et al., Filing Date: Mar. 31, 2000 Attorney Docket No. 7103–123.

(List continued on next page.)

*Primary Examiner*—Benjamin L. Utech
*Assistant Examiner*—Binh X. Tran
(74) *Attorney, Agent, or Firm*—Brinks Hofer Gilson & Lione

(57) ABSTRACT

A method of creating and using a polishing substrate having a coating layer that includes providing a substrate having a predetermined pattern disposed on a surface of the substrate and coating the surface of the substrate with an abrasive to form a coated substrate conforming to the predetermined pattern is described. In addition, an apparatus enabling preparation and use of a fixed abrasive polishing member is described that includes a patterned substrate, an abrasive coating a surface of the patterned substrate and a vacuum deposition chamber in which the abrasive is applied to the surface of the substrate. In addition, rather than a fixed abrasive, non-abrasive material may be applied to the surface of the patterned substrate, in which case, a conventional slurry may be used in planarization of an applied semiconductor wafer.

33 Claims, 3 Drawing Sheets

U.S. PATENT DOCUMENTS

| | | | | |
|---|---|---|---|---|
| 5,177,908 | A | 1/1993 | Tuttle | 451/41 |
| 5,197,999 | A | 3/1993 | Thomas | 51/298 |
| 5,212,910 | A | 5/1993 | Breivogel et al. | 451/530 |
| 5,234,867 | A | 8/1993 | Schultz et al. | 438/692 |
| 5,257,478 | A | 11/1993 | Hyde et al. | 451/287 |
| 5,287,663 | A | 2/1994 | Pierce et al. | 451/539 |
| 5,329,734 | A | 7/1994 | Yu | 451/41 |
| 5,335,453 | A | 8/1994 | Baldy et al. | 451/168 |
| 5,433,651 | A | 7/1995 | Lustig et al. | 451/6 |
| 5,484,323 | A | 1/1996 | Smith | 451/10 |
| 5,487,697 | A | 1/1996 | Jensen | 451/324 |
| 5,489,233 | A | 2/1996 | Cook et al. | 451/141 |
| 5,531,635 | A | 7/1996 | Mogi et al. | 451/72 |
| 5,534,106 | A | 7/1996 | Cote et al. | 438/693 |
| 5,536,202 | A | 7/1996 | Appel et al. | 451/285 |
| 5,547,417 | A | 8/1996 | Breivogel et al. | 451/58 |
| 5,558,568 | A | 9/1996 | Talieh et al. | 451/303 |
| 5,575,707 | A | 11/1996 | Talieh et al. | 451/173 |
| 5,578,362 | A | 11/1996 | Reinhardt et al. | 428/147 |
| 5,593,344 | A | 1/1997 | Weldon et al. | 451/296 |
| 5,605,760 | A | 2/1997 | Roberts | 428/409 |
| 5,611,943 | A | 3/1997 | Cadien et al. | 216/88 |
| 5,622,526 | A | 4/1997 | Phillips | 451/72 |
| 5,643,044 | A | 7/1997 | Lund | 451/5 |
| 5,655,951 | A | 8/1997 | Meikle et al. | 451/56 |
| 5,692,947 | A | 12/1997 | Talieh et al. | 451/41 |
| 5,692,950 | A | 12/1997 | Rutherford et al. | 451/551 |
| 5,725,417 | A | 3/1998 | Robinson | 451/156 |
| 5,759,918 | A | 6/1998 | Hoshizaki et al. | 438/692 |
| 5,762,536 | A | 6/1998 | Pant et al. | 451/6 |
| 5,779,526 | A | 7/1998 | Gill | 451/324 |
| 5,810,964 | A | 9/1998 | Shiraishi | 156/345.12 |
| 5,871,390 | A | 2/1999 | Pant et al. | 451/5 |
| 5,897,426 | A | 4/1999 | Somekh | 451/41 |
| 5,899,798 | A | 5/1999 | Trojan et al. | 451/259 |
| 5,908,530 | A | 6/1999 | Hoshizaki et al. | 156/345.14 |
| 5,958,794 | A * | 9/1999 | Bruxvoort et al. | 438/692 |
| 6,093,651 | A * | 7/2000 | Andideh et al. | 438/692 |
| 6,106,351 | A * | 8/2000 | Raina et al. | 445/24 |
| 6,206,759 | B1 * | 3/2001 | Agarwal et al. | 451/41 |

OTHER PUBLICATIONS

U.S. patent application Ser. No. 09/540,810 Fixed Abrasive Linear Polishing Belt and System—Inventors: Zhao et al. Filing Date: Mar. 31, 2000 Attorney Docket No. 7103–135.

U.S. patent application Ser. No. 09/541,144 Method and Apparatus for Chemical Mechanical Planarization and Polishing of Semiconductor Wafers Using a Continuous Polishing Member Feed—Inventors: Moork.

U.S. patent application Ser. No. 09/386,741 Unsupported Chemical Mechanical Polishing Belt—Invertors: Xu et al. Filing Date: Aug. 31, 1999 Attorney Docket No. 7103/83.

Inaba, S., Katsuyama, T., Tanaka, M., "Study of CMP Polishing pad Control Method", Feb. 19–20, 1998 CMP MIC Conference, 1998 IMIC–300P/98/0444.

* cited by examiner

METHOD AND APPARATUS FOR FIXED ABRASIVE SUBSTRATE PREPARATION AND USE IN A CLUSTER CMP TOOL

FIELD OF THE INVENTION

The present invention relates to the field of fixed abrasive substrates. More particularly, the invention relates to a method and apparatus for fixed abrasive preparation and use in a cluster chemical-mechanical polishing (CMP) tool.

BACKGROUND

One of the last stages before fabrication of semiconductor devices on a semiconductor substrate, such as Si or III–V related compounds (e.g. GaAs, InP), involves the polishing of the semiconductor wafer. One reason wafer polishing is performed is to remove any irregularities present on the surface so that the wafer is smooth and flat prior to performing any initial fabrication steps (such as etch, metalization or photolithography). In addition, CMP is also used to planarize the semiconductor wafer subsequent to initiation of device fabrication, for example after deposition of polyamide or other insulating material on the wafer.

In general, prior to device fabrication, there are two types of polishing: rough polishing and chemical-mechanical polishing (CMP) in which the rough polishing precedes the CMP. Rough polishing is a conventional abrasive process whose primary purpose is to remove the surface damage leftover from the wafer-slicing process of diamond saws that created the wafer. CMP follows the rough polishing and is typically a combination of chemical etching and mechanical buffing. During device fabrication, only CMP is used as rough polishing is too abrasive to afford the necessary planarization control.

In a conventional CMP rotary or orbital system, wafers are mounted upside-down on rotating circular holders and lowered onto a polishing pad rotated in the opposite direction. The polishing pad is generally polyurethane or urethane-coated with felt and sits on a pallet. For ridding the surface of irregularities prior to fabrication, a slurry containing silica suspended in a mild etchant such as potassium or ammonium hydroxide is added to the polishing pad. A thin layer of silicon dioxide chemically grows on the surface of the wafer as a result of contact with the alkaline slurry. This layer is continuously removed mechanically by the buffing action of the polishing pad. The process generally reduces the irregularities of the wafer to a small percentage of the wafer diameter over the entire surface of the wafer. For planarization during processing, e.g. planarizing to flatten the wafer profile in multi-metal interconnection schemes, the CMP apparatus must remove oxides and various metals in addition to any planarizing material and/or wafer material.

To achieve the necessary precision without polishing away the active circuitry, a number of variables in any CMP apparatus can be controlled. For example, the numerous diverse variables that can be controlled include: composition of the slurry, rate of feed or introduction of the slurry to the pad, pad characteristics (both the pad material and the condition of the pad), polishing time, rotational speed of both the pad and wafer, and pressure of the wafer on the pad. The slurry characteristics to be controlled include the particulate size and pH of the etchant solution. In addition, slurries are chosen to balance chemical removal with abrasiveness so that the production rate of wafers through the CMP apparatus is acceptable (as is the planarity of the resultant wafer).

More recently, some current CMP systems/modules have eschewed conventional slurries as described above, turning to fixed abrasive polishing instead. To date, a number of forms of fixed abrasives exist. Materials are produced either as a roll or as a fixed pad. The roll is slowly and continuously fed into a CMP module, while the fixed pad is applied to the conventional rotary or orbital system. At least one of the problems with these current fixed-abrasive CMP systems is similar to that of more-conventional slurry-type systems; a high cost of ownership of the system for the user. Additional problems include both inconsistent results of the fixed abrasive as the abrasive wears away due to usage and reliance on third-party produced consumable abrasive or slurry material.

BRIEF SUMMARY

To solve these problems, an arrangement containing a modified fixed abrasive material and method of using the same has been developed using a pre-patterned substrate onto which the fixed abrasive is disposed.

A first aspect of the present invention is directed towards a method of fixed abrasive substitute preparation and use. The method entails providing a substrate having a predetermined pattern on a surface of the substrate and introducing an abrasive/binder mixture to the surface of the substrate. The abrasive/binder mixture coats the pattern on the surface of the substrate. A semiconductor wafer is planarized to a desired uniformity by the interaction of coated substrate and the semiconductor wafer. In one embodiment, the method may include patterning the substrate prior to introducing the abrasive/binder mixture to the surface of the substrate. Introducing the abrasive/binder mixture to the surface of the substrate may include vacuum depositing the abrasive/binder mixture o n the surface of the substrate. Similarly, the method may include a cure mechanism enabling curing of the binder such that the abrasive better adheres to the surface of the semiconductor. In other embodiments, the method may include stripping the substrate of remaining abrasive subsequent to planarizing semiconductors wafers. The stripping of the abrasive occurs in cleaning chamber and the substrate would be subsequently transferred to a deposition chamber in which the substrate would be re-coated with the abrasive/binder mixture to which new semiconductor wafers requiring planarization may be applied.

A second aspect of the present invention is directed towards an arrangement using a pre-patterned substrate containing a fixed abrasive coated on a surface of the substrate and a wafer to which the coated substrate is applied. The second aspect of the invention may also include a vacuum deposition chamber in which an abrasive/binder mixture is applied and a chemical-mechanical polishing chamber to which the substrate and wafers are introduced and the wafer planarized. A curing mechanism may also be included in which the abrasive/binder mixture is annealed, allowing the abrasive to better adhere to the surface of the substrate. The second aspect of the invention may also incorporate the use of a cleaning chamber in which the remaining abrasive after planarization is stripped from the surface of the substrate and after which the substrate is transferred to the deposition chamber and the abrasive/binder mixture is reapplied to the surface of the substrate.

It is therefore an advantage of the present invention to increase the reliability and decrease the cost of a CMP system by providing an arrangement and method to better control the amount of abrasive material used during planarization of a semiconductor wafer. An additional advantage of the present invention is the improvement in process control of the planarization of the semiconductor wafer.

The following figures and detailed description of the preferred embodiments will more clearly demonstrate these and other objects and advantages of the invention.

DETAILED DESCRIPTION OF THE PRESENTLY PREFERRED EMBODIMENTS

Figure 1:
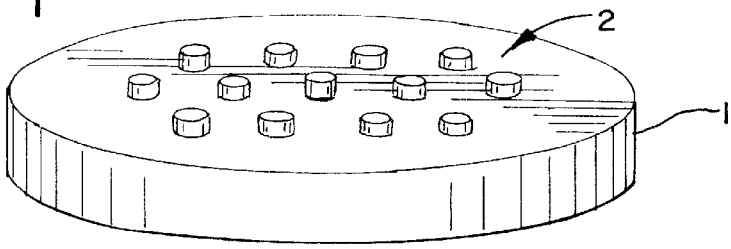
FIG. 1 illustrates a top view of a first embodiment of a patterned substrate of the present invention.
Figure 2:
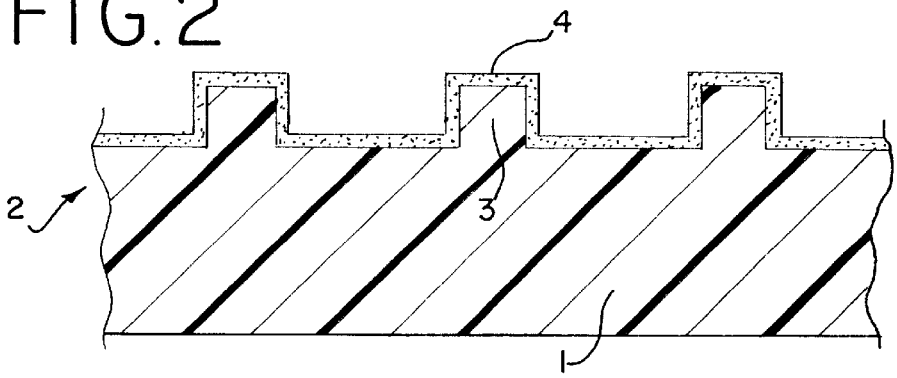
FIG. 2 shows a side view of a first embodiment of a patterned substrate of the present invention.

FIGS. 1 and 2 depict top and side views of a preferred embodiment of a fixed abrasive substrate according to the present invention. In FIG. 1, a substrate 1 is provided with an abrasive-coated predetermined pattern 2. FIG. 2 depicts a side view of the coated substrate 1 better showing the abrasive-coated predetermined pattern 2, which consists of a predetermined pattern 3 and a fixed abrasive 4 coating the pattern 3.

The substrate 1 is made of a durable material that is suitable for use in a standard vacuum deposition process. Examples of typical materials include, but are not limited to, ceramic, rigid plastic or other rigid material such as polyethylene terephthalate (PET). The substrate is generally purchased from a vendor of the particular material that comprises the substrate.

The substrate pattern is a three-dimensional topographical pattern that may be prepared by a number of different methods, including physically or chemically etching the substrate to form the pattern or depositing the pattern on the substrate via a deposition process. In the latter case, i.e. deposition, the pattern may be formed of either the same material as the substrate or a different material that is maintained on the substrate through repeated deposition of abrasive on the substrate and cleaning of the substrate by removal of the abrasive remaining on the substrate after numerous planarizations. In addition, the pattern on a substrate may be altered as desired by re-patterning the substrate. This may be accomplished by stripping (or partially stripping) the substrate of the prior pattern, cleaning the substrate and re-etching or re-depositing pattern material on the substrate. Although either chemical means (e.g. chemical etching) or mechanical means (e.g. grinding, mechanical etching) may be used to strip a prior pattern from the substrate, chemical means are generally used to clean the substrate, either when removing the abrasive or after stripping the prior pattern.

Figure 3A:
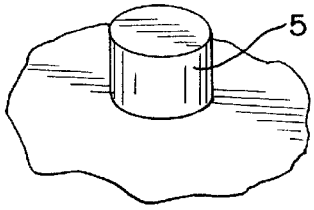
FIGS. 3A and 3B show second and third embodiments of patterned substrates of the present invention.
Figure 3B:
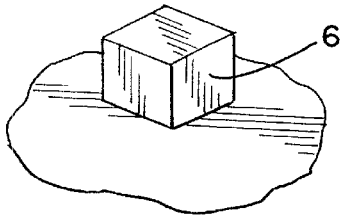

The substrate pattern 3 is selected such that die-level and/or wafer-level planarization is optimized when the abrasive-coated substrate pattern 2 is applied to a desired semiconductor wafer to be planarized. The shape of the substrate pattern 3 is particularly important for maintaining stability in the chemical-mechanical polishing process. A general objective is to select a pattern that will enable chemical transport of slurry or other fluid-based chemistry to the wafer/substrate interface and reaction by-product away from the substrate. One advantage of using a predetermined pattern is that the density of the pattern (both the number of shapes/unit area on the substrate and the amount of pattern/unit area on the substrate) is preset, thus allowing the user to select a pattern to best suit the processing needs for a particular wafer by increasing control over the planarization process. One suitable range of pattern density is from 60% to 95%. In addition to pattern density, the specific pattern profile, i.e. shape, may be selected. For example, in some cases the surface area of the fixed abrasive that contacts the surface of the semiconductor wafer during polishing may be desired to be constant for predictability and reliability reasons. One preferred shape having a constant cross-section is a pillar-like shape. Examples of typical pillar-like patterns with constant surface area with wear are shown in FIGS. 3A and 3B. FIG. 3A illustrates a circular-type pillar 5 while FIG. 3B depicts a square-based pillar 6. Alternate pillar shaped patterns having a surface area that remains constant with usage, such as ovular-type or rectangular-based pillars (not shown), may be constructed in addition to those depicted in FIGS. 3A and 3B.

Figure 4A:
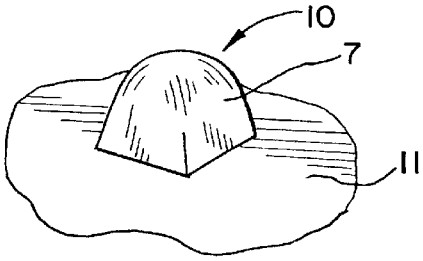
FIGS. 4A and 4B depict fourth and fifth embodiments of patterned substrates of the present invention.
Figure 4B:
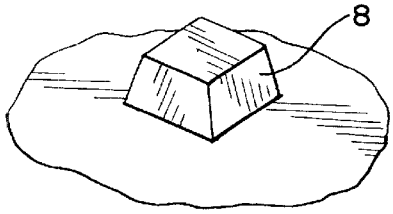
Figure 5:
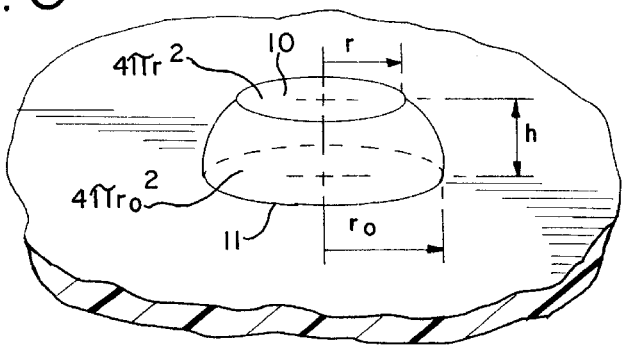
FIG. 5 illustrates the change in surface area of the patterned substrate according to the fifth embodiment of the present invention.

Other patterns may also be used in which the surface area does not remain constant with usage as shown in FIGS. 4A and 4B. FIG. 4A depicts a side view of a substrate 1 having hemispherical patterns 7, while FIG. 4B shows a side view of a substrate 1 having trapezoidal patterns 8. Once a substrate having these or similar patterns is coated with the abrasive, and is then used to polish a semiconductor wafer, the coated abrasive wears away while polishing the wafer to expose an increasing amount of abrasive (i.e. the surface area of the abrasive increases). This is because, as in the above patterns with constant cross-sectional area, the abrasive covers the surface of the individual pattern, e.g. a hemisphere. In this case, as opposed to a pillar-like pattern, the cross-sectional area of the uncoated hemisphere itself increases from the top of the air/pattern interface 10 to the pattern/substrate interface (the base) 11. Thus, the increase in surface area of the abrasive due to erosion with usage parallels a similar increase in cross-sectional area of the hemisphere. In this case, the surface area is $4\pi(r_0-h)^2$, where $r_0$ is the radius of the hemisphere and h is the distance from the base of the hemisphere 11 to the top of the air/interface 10, as shown in FIG. 5.

Figure 6:
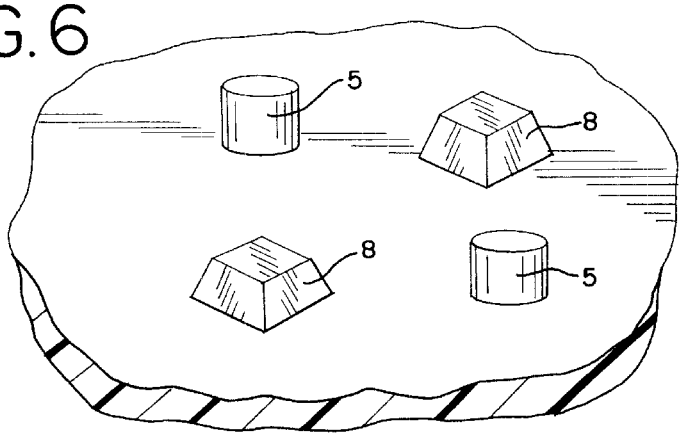
FIG. 6 shows a sixth embodiment of a patterned substrate of the present invention.

Patterns having increasing surface area during usage may be used where a high degree of surfacing with a smaller abrasive contact area is initially desired and subsequently the benefit of a larger abrasive contact area is desired during polishing/planarization of the semiconductor wafer. Alternatively, a combination of patterns with constant and increasing surface area may be used, as illustrated in FIG. 6. In this embodiment, the substrates having a combination of patterns may be used where one type of pattern enables another type of pattern to achieve a desired result or enhances the result obtained by another type of pattern. For example, assuming only two types of patterns, pattern A and pattern B, exist on the substrate, pattern A may enable activation of the material surface, say via chemistry of an alkali slurry, while pattern B may remove the activated material. In this embodiment, pattern A preferably has a smaller surface area (locally) than pattern B. Pattern A would then provide a higher pressure to the wafer surface than pattern B and allow chemical action to occur on the wafer, and the lower pressure imparted by pattern B would act to remove activated material. Although specific dimensions may vary, in any of the above patterns, either those having constant or increasing cross-sectional area, typical features of a particular shape might be a maximum height (as measured from the base and shown in FIG. 5 as h) of 20–50 $\mu$m and a maximum width of 100–1000 $\mu$m (i.e. $2\times r_0$ in FIG. 5).

Figure 7A:
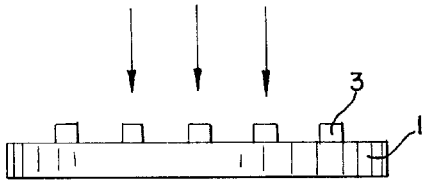
FIGS. 7A and 7B show side views of the first embodiment of the present invention before and after deposition of the fixed abrasive.
Figure 7B:
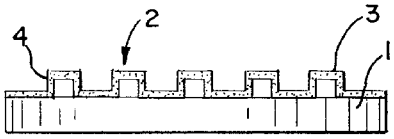

The process by which the substrate having a predetermined pattern is coated and used will be described with respect to FIGS. 7–10. Initially, one surface of the substrate is patterned with the desired pattern characteristics, including shape and density as mentioned above, using standard methods. The substrate may be in the form of a rotary disk, linear belt or other desired shape. After preparation of the substrate, the pre-patterned substrate is loaded into a standard deposition (vacuum) chamber 50. The deposition chamber 50 is evacuated to a pressure $\leqq 1$ $\mu$Torrsand then backfilled to a desired deposition pressure with an appropriate deposition gas. A fixed abrasive/binder mixture is then vacuum deposited on the substrate, as shown in FIGS. 7A and 7B. FIG. 7A shows the substrate prior to deposition of the mixture and FIG. 7B depicts the combination of the substrate and mixture subsequent to deposition.

The abrasive of the fixed abrasive/binder mixture may be formed of silica and/or other materials such as ceria, manganese oxide or similar earthmetal oxide material of appropriate hardness. In one embodiment, the particles that comprise the abrasive may range in size from 0.1 $\mu$m to 3.0 $\mu$m. The binder allows the abrasive to adhere to the substrate. The binder may be made from any of several conventional binding mixtures such as organic polymers. Of course, alternate processes may be used as well, such as individual deposition of the binder material andy the abrasive material or deposition of the abrasive material without the binder material. If the abrasive material is deposited without a separate binder material, the abrasive may adhere with enough strength to allow planarization of a semiconductor wafer or a curing process performed by a cure mechanism (described below) may be applied to the substrate prior to planarization of the semiconductor wafer.

Following the deposition, the substrate and fixed abrasive/binder mixture combination may be annealed or subjected to a curing process if necessary. The curing process sets the binder to more firmly adhere the abrasive to the substrate and may be performed either in-situ with the deposition process or ex-situ, in a separate cure mechanism. This is to say that, if the curing process is performed in situ, the substrate remains in the deposition chamber 50 at atmospheric pressure or less and annealing is performed by the cure mechanism in a range of temperatures between room temperature (approximately 20° C.) and the material melting point (typically >150° C.), depending on the particular binder used. The curing process can also be performed ex-situ, in which case the substrate and fixed abrasive/binder mixture combination is removed from the deposition chamber 50 and annealed in an ambient atmosphere and temperature depending on the particular binder used. In this case, the substrate may be annealed in a separate cure mechanism, such as a conventional annealing apparatus.

Subsequent to the deposition and/or curing process, the substrate is transferred to a CMP system, such as the TERMS polishing system available from Lam Research Corp., Fremont, Calif. As described previously, the substrate may either be prepared as a roll or a fixed pad. Thus, the substrate having the fixed abrasive may be in a fixed pad/wafer-type form or a continuous roll, and is used to polish and/or planarize semiconductor wafers introduced to the CMP system. The fixed pad-type substrate is applied to a rotary or orbital CMP system 100, as shown in FIG. 8, while the prepared substrate/roll is slowly and continuously fed into the CMP system 200 as shown in FIG. 9.

Figure 8:
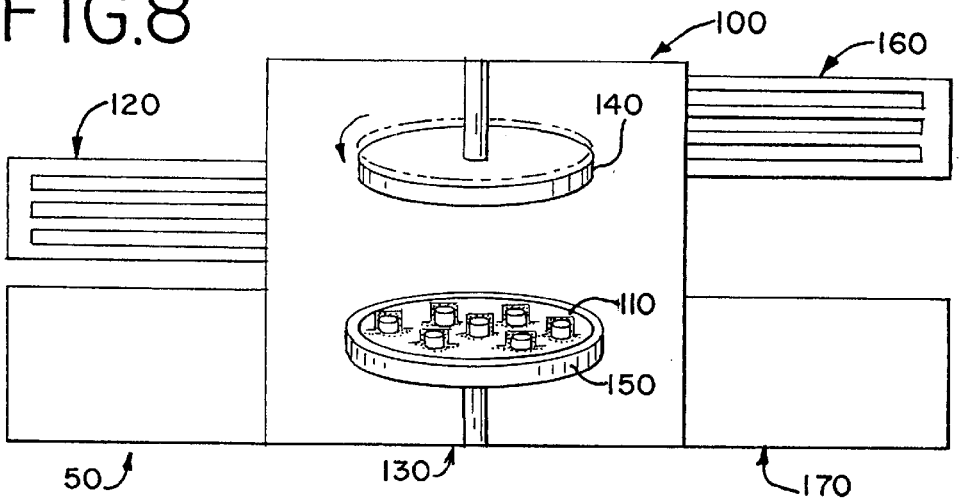
FIG. 8 shows a rotary-type CMP system of the present invention.
Figure 9:
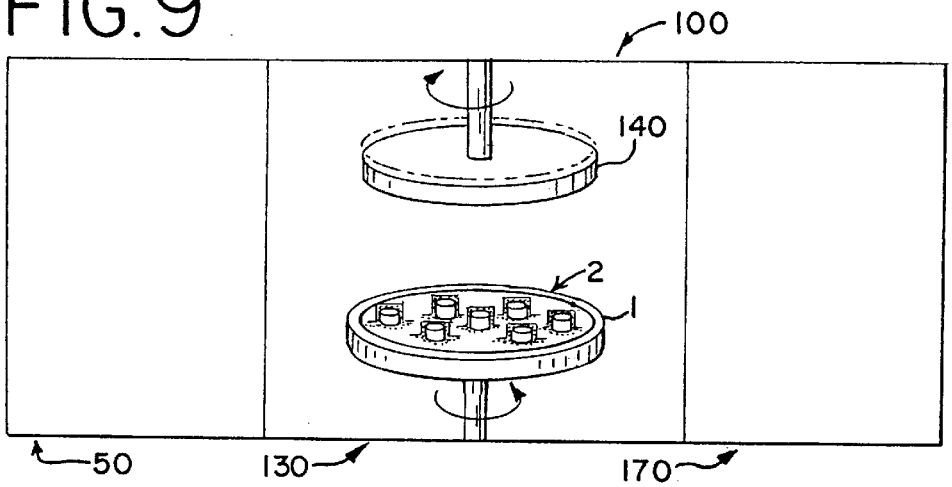
FIG. 9 shows a continuous feed-type CMP system of the present invention.

FIG. 8 illustrates a stand-alone CMP system 100 in which either a single substrate 110 is prepared and loaded into the CMP system 100 or a plurality of single substrates are prepared and loaded into a magazine-style feeder 120. The loaded feeder 120 is then installed into the CMP system 100 for automated loading and unloading of an individual substrate 110 contained in the loaded feeder 120. The automated loading system of the CMP system 100 loads an individual substrate 110 contained in the loaded feeder 120 into an application chamber 130. A semiconductor wafer 140 to be planarized is introduced into the application chamber 130 either before or after the substrate 110 is loaded. The substrate 110 is rotated at a predetermined spin speed while the wafer 140 is rotated in the opposite direction at a spin speed to achieve a desired relative surface velocity. Typical relative surface velocities are 125 to 400 feet per minute, however even higher relative surface velocities may be used. In addition, although as depicted the substrate 110 is held from the top and the wafer 140 is retained from the bottom of the CMP system 100, the relative positions of the substrate 110 and wafer 140 may be reversed. The wafer 140 is usually retained on a chuck 150 by vacuum clamping.

After the abrasive coating on the loaded substrate 110 has eroded by wear to a preset amount, the substrate 110 is unloaded and may be placed in a reclaim magazine 160. The reclaim magazine 160 is filled with at least one eroded substrate and subsequently transferred from the application chamber 130 to a cleaning chamber 170. Although depicted in-situ in FIG. 8, the cleaning chamber 170 may be a separate module from the CMP system 100. Commercially available cleaning chambers, such as wet cleaning chambers utilizing sulfuric-peroxide wet cleaning chemistry available from FSI International, Inc. of Chaska, Minn., cleaning chambers from Semitool, Inc. of Kalispell, Mont., or a standard plasma-assisted gas etch utilizing $O_2$ plasma followed by a brush scrub clean in an OnTrak scrubber available from Lam Research Corporation of Fremont, Calif., may be used to clean the substrate via chemical means described below.

Figure 10:
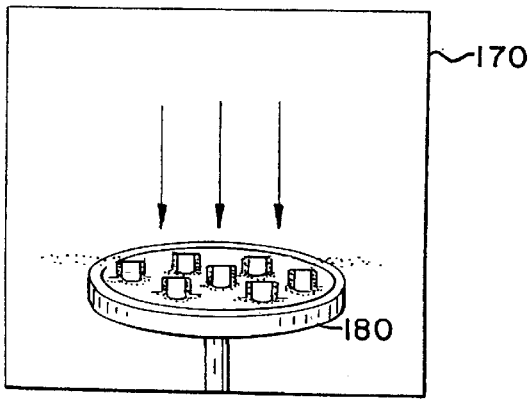
FIG. 10 shows a used substrate disposed in a cleaning chamber of the present invention.

As depicted in FIG. 10, when the eroded substrate 180 is disposed in the cleaning chamber 170, which is downstream of the chemo-mechanical polishing chamber, the remaining abrasive is removed from the eroded substrate 180 thereby cleaning the substrate. One approach may be to introduce a gas chemistry to etch away the remaining abrasive. These types of processes are usually assisted by plasma energy. A typical etch process may include evacuation of the etch chamber to $\leqq 1$ $\mu$Torr, backfilling with an etch chemistry and applying power to generate a plasma.

After the etch process is complete, the chamber is vented back to atmosphere and the substrate is removed. This is to say that, subsequent to cleaning, the stripped substrate (indicated by dashes) containing the original predetermined pattern is then transferred to the deposition chamber 50 by a substrate transfer mechanism such as a robot/robotic arm. Note that the substrate, during transfer, may be contained in the reclaim magazine 160, which has a number of cartridges to hold individual substrates. A fresh abrasive/binder mixture is applied to coat the previously denuded substrate. The process for coating the substrate with the abrasive/binder mixture is the same as that described above. As mentioned before, the deposition chamber 50, application chamber 130 and cleaning chamber 170 may be individual modules, or may be integral parts of the entire CMP system 100.

The use of the present invention has advantages, one of which is a lower cost of ownership for the owner of the CMP system as purchase of external manufactured consumables (pads, etc . . . ) from third party sources are reduced/replaced by purchase of (lower cost) raw materials. In addition, this invention allows control of the abrasiveness of the pad by allowing pattern characteristics such as pattern density, shape and size to be predetermined and/or modified. Further, the present invention permits the user to set the desired abrasive characteristics such as abrasiveness and thickness of the coating as desired, thus allowing an even finer control of planarization.

Alternately, rather than applying fixed abrasive to the surface of the patterned substrate, other materials may be applied. For example, a non-abrasive pad-type material may be introduced to the surface of the substrate. The pad-type material may be polyurethane or other suitable compound, similar to the material of conventional pads used in standard planarization processes. The method of introducing the material to the pre-patterned substrate would be similar to that above, e.g. depositing and adhering (if necessary) the pad-type material on the surface of the substrate, applying the coated substrate to at least one semiconductor wafer requiring planarization, stripping the pad-type material after the pad-type material is sufficiently eroded (i.e. cleaning the substrate), replacing the pad-type material, and reusing the pad-type material. As above, the particular material used determines the specifics of the process, e.g. atmospheres, timing, and temperatures during processing. In this case, however, as the abrasives are not fixed, conventional slurries may be used during planarization of semiconductor wafers, having replaced the conventional pad with the pre-patterned substrate coated with the pad-type material of the present invention. Substrates prepared with standard pad coatings would then be usable with abrasive slurries commonly available in the CMP industry.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

What is claimed is:

1. A method of preparation and use of a polishing substrate to polish a semiconductor wafer comprising:

providing a substrate having a substrate pattern on a surface of the substrate;

coating the surface of the substrate with a coating layer;

transferring the substrate to a chemical-mechanical polishing chamber subsequent to coating the surface of the substrate with the coating layer;

planarizing a semiconductor wafer using the coated substrate transferring the substrate to a cleaning chamber subsequent to planarizing at least one semiconductor wafer;

cleaning the substrate by at least removing a remainder of the coating layer from the surface of the substrate;

transferring the substrate to a position in which the surface of the substrate is positioned to receive a new coating layer; and coating the surface of the substrate with the new coating layer.

2. The method of claim 1, wherein coating the surface of the substrate with the coating layer comprises vacuum depositing the coating layer on the surface of the substrate.

3. The method of claim 1, wherein coating the surface of the substrate comprises coating the surface of the substrate with a layer that comprises an abrasive/binder mixture.

4. The method of claim 3, further comprising subjecting the surface of the substrate coated with the abrasive/binder mixture layer to a curing mechanism to bind the abrasive/binder mixture layer to the surface of the substrate.

5. The method of claim 1, further comprising selecting the substrate pattern prior to coating the surface of the substrate with the coating layer such that die-level and wafer-level planarization performance is optimized during planarization of the semiconductor wafer, the pattern being selected from the group consisting of a rectangular pattern, a trapezoidal pattern, a hemispherical pattern, a pillar pattern and a prismatic pattern.

6. The method of claim 5, wherein selecting the substrate pattern comprises selecting the substrate pattern such that an area of the coated layer exposed as a fixed consumable remains constant as abrasive is worn away during a planarization process.

7. The method of claim 5, wherein selecting the substrate pattern comprises selecting the substrate pattern such that the substrate pattern has a height of about 20 $\mu$m to about 50 $\mu$m and a maximum width of about 100 $\mu$m to about 1000 $\mu$m.

8. The method of claim 1, wherein coating the substrate with the coating layer comprises coating the substrate with an abrasive layer.

9. The method of claim 8, further comprising coating the surface of the substrate with a binder layer prior to coating the surface of the substrate with the abrasive layer.

10. The method of claim 9, further comprising subjecting the surface of the substrate coated with the binder layer and abrasive layer to a curing process to bind the abrasive layer to the surface of the substrate.

11. The method of claim 1, wherein coating the substrate with the coating layer comprises coating the substrate with a non-abrasive material layer, wherein the non-abrasive material is suitable for use with an abrasive slurry.

12. The method of claim 11, further comprising coating the surface of the substrate with a binder layer prior to coating the surface of the substrate with the non-abrasive material layer.

13. The method of claim 12, further comprising subjecting the surface of the substrate coated with the binder layer and non-abrasive material layer to a curing process to bind the non-abrasive material layer to the surface of the substrate.

14. A method of preparation and use of a polishing substrate to polish a semiconductor wafer comprising:

providing a substrate hating a substrate pattern on a surface of the substrate;

coating the surface of the substrate with an abrasive having particles of 0.1 $\mu$m to 3.0 $\mu$m;

transferring the substrate to a chemical-mechanical polishing chamber subsequent to coating the surface of the substrate with the abrasive;

planarizing a semiconductor wafer using the coated substrate;

transferring the substrate to a cleaning chamber subsequent to planarizing at least one semiconductor wafer;

cleaning the substrate by at least removing a remainder of the abrasive from the surface of the substrate;

transferring the substrate to a position in which the surface of the substrate is positioned to receive a new coating of abrasive; and coating the surface of the substrate with the new coating of abrasive.

15. The method of claim 14, further comprising coating the surface of the substrate with a binder prior to coating the surface of the substrate with the abrasive.

16. The method of claim 15, further comprising subjecting the surface of the substrate coated with the binder and abrasive to a curing process to bind the abrasive to the surface of the substrate.

17. The method of claim 14, wherein coating the surface of the substrate comprises coating the surface of the substrate with an abrasive/binder mixture.

18. The method of claim 17, further comprising subjecting the surface of the substrate coated with the abrasive/binder mixture to a curing mechanism to bind the abrasive/binder mixture to the surface of the substrate.

19. The method of claim 14, further comprising selecting the substrate pattern prior to coating the surface of the substrate with the abrasive such that die-level and wafer-level planarization performance is optimized during planarization of the semiconductor wafer, the pattern being selected from the group consisting of a rectangular pattern, a trapezoidal pattern, a hemispherical pattern, a pillar pattern and a prismatic pattern.

20. The method of claim 19, wherein selecting the substrate pattern comprises selecting the substrate pattern such that the substrate pattern has a height of about 20 $\mu$m to about 50 $\mu$m and a maximum width of about 100 $\mu$m to about 1000 $\mu$m.

21. The method of claim 19, wherein selecting the substrate pattern comprises selecting the substrate pattern such that the substrate pattern has a density of 60–95%.

22. A method of preparation and use of a polishing substrate to polish a semiconductor wafer comprising:

providing a substrate having at least two substrate patterns on a surface of the substrate;

coating the surface of the substrate with a coating;

transferring the substrate to a chemical-mechanical polishing chamber subsequent to coating the surface of the substrate with the abrasive;

planarizing a semiconductor wafer using the coated substrate;

transferring the substrate to a cleaning chamber subsequent to planarizing at least one semiconductor wafer;

cleaning the substrate by at least removing a remainder of the coating layer from the surface of the substrate;

transferring the substrate to a position in which the surface of the substrate is positioned to receive a new coating layer; and coating the surface of the substrate with the new coating layer.

23. The method of claim 22, further comprising selecting the substrate patterns prior to coating the surface of the substrate with the coating such that die-level and wafer-level planarization performance is optimized during planarization of the semiconductor wafer, the patterns being selected from the group consisting of a rectangular pattern, a trapezoidal pattern, a hemispherical pattern, a pillar pattern and a prismatic pattern.

24. The method of claim 22, wherein selecting the substrate patterns comprises selecting the substrate patterns such that the substrate patterns have a height of about 20 $\mu$m to about 50 $\mu$m and a maximum width of about 100 $\mu$m to about 1000 $\mu$m.

25. The method of claim 22, wherein selecting the substrate patterns comprises selecting the substrate patterns such that the substrate patterns have a combined density of 60–95%.

26. The method of claim 22, wherein coating the surface of the substrate comprises coating the surface of the substrate with an abrasive/binder mixture.

27. The method of claim 26, further comprising subjecting the surface of the substrate coated with the abrasive/binder mixture layer to a curing mechanism to bind the abrasive/binder mixture layer to the surface of the substrate.

28. The method of claim 22, wherein coating the substrate with the coating layer comprises coating he substrate with an abrasive layer.

29. The method of claim 28, further comprising coating the surface of the substrate with a binder layer prior to coating the surface of the substrate with the abrasive layer.

30. The method of claim 29, further comprising subjecting the surface of the substrate coated with the binder layer and abrasive layer to a curing process to bind the abrasive layer to the surface of the substrate.

31. The method of claim 22, wherein coating the substrate with the coating layer comprises coating the substrate with a non-abrasive material layer, wherein the non-abrasive material is suitable for use with an abrasive slurry.

32. The method of claim 31, further comprising coating the surface of the substrate with a binder layer prior to coating the surface of the substrate with the non-abrasive material layer.

33. The method of claim 32, further comprising subjecting the surface of the substrate coated with the binder layer and non-abrasive material layer to a curing process to bind the non-abrasive material layer to the surface of the substrate.

* * * * *

UNITED STATES PATENT AND TRADEMARK OFFICE

CERTIFICATE OF CORRECTION

PATENT NO. : 6,495,464 B1
DATED : December 17, 2002
INVENTOR(S) : John M. Boyd et al.

It is certified that error appears in the above-identified patent and that said Letters Patent is hereby corrected as shown below:

Column 8,
Line 61, delete “hating” and substitute -- having -- in its place.

Column 10,
Line 32, after “coating” delete “he” and substitute -- the -- in its place.

Signed and Sealed this

Sixteenth Day of November, 2004

JON W. DUDAS
*Director of the United States Patent and Trademark Office*